United States Patent [19]

Hale

[11] Patent Number: 4,490,191

[45] Date of Patent: Dec. 25, 1984

[54] COATED PRODUCT AND PROCESS

[75] Inventor: Thomas E. Hale, Warren, Mich.

[73] Assignee: General Electric Company, Detroit, Mich.

[21] Appl. No.: 331,368

[22] Filed: Dec. 16, 1981

[51] Int. Cl.[3] ..... B32B 15/04

[52] U.S. Cl. ..... 148/31.5; 428/627; 428/629; 428/623; 428/632; 428/633; 428/925; 428/932; 428/698; 428/215; 428/699; 428/700

[58] Field of Search ..... 148/31.5; 428/627, 629, 428/632, 633, 623, 925, 932, 215, 698, 699, 700

[56] References Cited

U.S. PATENT DOCUMENTS

| | | | |
|---|---|---|---|
| Re. 29,420 | 9/1977 | Lindstrom et al. | 428/336 |
| 3,640,689 | 2/1972 | Glaski et al. | 29/195 |
| 3,736,107 | 5/1973 | Hale | 148/31.5 |
| 3,836,392 | 9/1974 | Lux et al. | 148/6.3 |
| 3,837,896 | 9/1974 | Lindstrom et al. | 428/457 |
| 3,955,038 | 5/1976 | Lindstrom et al. | 428/457 |
| 4,018,631 | 4/1977 | Hale | 148/31.5 |
| 4,239,536 | 12/1980 | Yamamoto et al. | 428/379 |
| 4,357,382 | 11/1982 | Lambert et al. | 428/216 |

FOREIGN PATENT DOCUMENTS

| | | | |
|---|---|---|---|
| 2528255 | 2/1976 | Fed. Rep. of Germany | 428/627 |
| 52-13201 | 4/1977 | Japan . | |
| 52-100376 | 8/1977 | Japan . | |
| 52-110209 | 9/1977 | Japan . | |
| 52-105396 | 9/1977 | Japan . | |
| 53-7513 | 1/1978 | Japan . | |
| 53-23810 | 3/1978 | Japan . | |
| 53-45607 | 4/1978 | Japan . | |
| 53-89805 | 8/1978 | Japan . | |
| 53-131909 | 11/1978 | Japan . | |
| 54-10314 | 1/1979 | Japan . | |
| 54-23608 | 2/1979 | Japan . | |
| 54-26811 | 2/1979 | Japan . | |
| 54-35182 | 3/1979 | Japan . | |
| 54-28315 | 3/1979 | Japan . | |
| 54-28316 | 3/1979 | Japan . | |
| 54-41211 | 4/1979 | Japan . | |
| 54-64513 | 5/1979 | Japan . | |
| 54-66912 | 5/1979 | Japan . | |
| 54-79180 | 6/1979 | Japan . | |
| 54-103409 | 8/1979 | Japan . | |
| 53-134719 | 10/1979 | Japan . | |
| 54-158779 | 12/1979 | Japan . | |
| 54-158775 | 12/1979 | Japan . | |
| 54-158780 | 12/1979 | Japan . | |
| 1284030 | 8/1972 | United Kingdom . | |

*Primary Examiner*—Veronica O'Keefe

*Attorney, Agent, or Firm*—Hedman, Gibson, Costigan & Hoare

[57] ABSTRACT

Improved adherence of oxide wear layers on hard metal or cemented carbide substrates is obtained by providing a thin surface-oxidized bonding layer comprising a carbide or oxycarbide of at least one of tantalum, niobium or vanadium, optionally adding aluminum to the bonding layer, and finally providing an outer oxide wear layer.

5 Claims, No Drawings

COATED PRODUCT AND PROCESS

This invention relates to coated articles comprising hard metals, refractories, and especially cemented carbide substrates. More particularly, it relates to such coated hard metal or coated cemented carbide products which are adapted to receive an aluminum oxide or other oxide wear layer which is very firmly bonded to the substrate.

Although the invention will be described with particular reference to cemented metal carbide substrates, other substrates are contemplated, e.g., nickel based alloys, and high melting refractories. Also, although the invention will be described with particular reference to tungsten as the carbide former, other carbide formers such as tantalum and titanium and the like can form the substrate. The carbide or mixed carbides are cemented or bonded together by matrix metals including cobalt, which matrix can also include iron or nickel or both of these metals. A typical cemented carbide contains tungsten carbide in a cobalt matrix.

Such hard metal and/or cemented carbide substrates are used in tools for machining and cutting metals. Their already high wear resistance can be significantly improved by providing oxide wear layers, such as aluminum oxide wear layers, as described in U.S. Pat. Nos. 3,736,107 and 3,836,392. However, it has become apparent that proper steps must be taken to adequately bond the oxide layer to the hard metal or cemented carbide substrate if the superior wear resistance of the oxide layer is to be realized.

In U.S. Pat. No. 4,018,631, it is disclosed that a selective pretreatment of cemented carbides before application of the oxide wear layer unexpectedly enhances and improves the adherence of the subsequently applied oxide wear layer. Specifically, in the '631 patent, a cemented carbide substrate containing tungsten and cobalt is provided with a coating selected from carbide, nitride, carbonitride and mixtures thereof, then heated to diffuse tungsten and cobalt from the substrate into the coating, the resulting diffused zone is oxidized, and finally the oxidized surface is covered with the oxide wear layer. While such a procedure results in a tightly adherent surface layer of aluminum oxide or other oxide wear layer, and is therefore extremely useful, the procedure is somewhat complicated and expensive to practice because of the high temperature required for the diffusion step.

A novel coating procedure has now been discovered which provides aluminum oxide and other oxides (e.g., hafnium oxide, zirconium oxide and the like) bonded to the substrates with adherence equal to that obtained in the said '631 patent, which can be performed at normal coating temperatures.

Such a procedure in its broadest aspects comprises providing a thin surface-oxidized bonding layer comprising a carbide or oxycarbide of at least one of tantalum, niobium and vanadium, optionally aluminizing the bonding layer, and finally providing an outer oxide wear layer.

The product of the invention differs from that of the '631 patent in the bonding layer composition. It differs from that of related prior art using interlayers in basic ways: U.K. Pat. No. 1,284,030 describes the use of an intermediate layer only to provide transition between the substrate and the coating; U.S. Pat. No. 3,640,689 describes an interlayer only to provide a barrier to deleterious reactions; U.S. Pat. Nos. 3,837,896; 3,955,038 and U.S. Pat. No. Re. 29,420, use a carbide (or nitride) intermediate layer, but only as a barrier; Japanese Patent Publications Nos. 23608/1979; 7513/1978; and 26811/1979 describe, respectively,aluminum oxide over a precisely defined titanium carbide double coating, using aluminum titanate intermediate layer; a specially defined titanium oxycarbide intermediate layer; or two inner layers, one a solid solution of Ti, Zr, or Hf oxide plus $Al_2O_3$, and the other a carbide, nitride or carbonitride of Ti, Zr or Hf; Japanese Pat. Nos. 131909/1978, 158779/1977 and 110209/1977 disclose, respectively, inner layers of complex compounds of oxygen, carbon or nitrogen containing metals of Groups IV-A, V-A or VI-A; TiC, TiN, TiCO, TiNO, or TiCNO, or carbides, nitrides, carbonitrides, or oxides of IVA, VA, VI A metals; and Japanese Pat. Nos. 89805/1978, 23810/1978, 158775/1979, 35182/1979 and 158780 disclose, respectively, complex intermediate layers of titanium oxycarbonitride, titanium oxycarbide, $Ti(C,O)_x$ inner; (TiAl) (N, O) y outer; carbide or carbonitride inner, carbide, oxycarbide, nitride, nitro-oxide carbonitride and/or oxycarbonitride; and TiC, TiN, TiCN, TiCO, TiNO, or TiCNO. The present bonding layer is thin, not useful as a barrier, and possesses a composition novel in its chemical constituents. All of the foregoing patents and publications are incorporated herein by reference.

DESCRIPTION OF THE INVENTION

According to the invention there is provided an article of manufacture comprising:

(i) a hard metal or cemented carbide substrate;

(ii) a surface-oxidized bonding layer adjacent the surface of said substrate, said bonding layer comprising at least one of the carbides or oxycarbides of tantalum, niobium and vanadium; and (iii) an oxide wear layer overlying said bonding layer.

In preferred features, the substrate is a cemented carbide; the bonding layer is 0.1 to 0.5 microns thick; aluminum is added to the bonding layer by a process to be described later; the oxide wear layer is aluminum oxide; and the wear layer is 0.5 to 20 microns thick.

In the process of the present invention a hard metal or cemented carbide substrate is pretreated for the reception of a wear resistant oxide coating by (a) treating the substrate in a first atmosphere selected from carbide and oxycarbide forming atmospheres to form a bonding layer of metal selected from at least one of tantalum, niobium or vanadium on said substrate; and (b) heating the coated substrate of (a) in a second oxidizing atmosphere until at least about 50% of the surface is oxidized.

In preferred features of the process aspect aluminum will be added to the bonding layer; and an oxide wear layer, preferably an aluminum oxide wear layer, will be deposited on the bonding layer, which optionally may contain aluminum.

Those skilled in this art will know the general techniques used to prepare the product and carry out the process of the present invention.

One convenient way of proceeding is to provide a coating furnace held at a temperature of from about 800° C. to 1300° C., and to expose a substrate in the furnace to the following sequential steps:

1. 5 to 60 minutes exposure, preferably at 1050° C., to a gaseous mixture of $H_2$ and 0.5 to 20 volume percent $TaCl_5$ or $NbCl_5$. $TiCl_4$, $AlCl_3$ and/or $CH_4$ may be optionally added during either part or all of this period.

2. 1 to 60 minutes exposure, preferably at 1100° C., to a gaseous mixture consisting of $H_2$ and about 1 to 50 volume percent $CO_2$ to oxidize and produce the pretreated substrate.
3. 5 to 60 minutes exposure, preferably at 1050° C., to a gaseous mixture of $H_2$ and about 0.5 to 20 volume percent $AlCl_3$. This step for adding aluminum is optional but is preferred for best results.
4. 15 minutes' to 4 hours' exposure, preferably 1050° C., to a gaseous mixture of $H_2$, 1 to 40 (or 60 to 95) volume percent $CO_2$, and 2.5 to 20 volume percent $AlCl_3$ to produce the aluminum oxide wear coating.

Other suitable treating atmospheres of varying proportions of constituents will occur to those skilled in the art. Likewise, other well known deposition techniques can be used such as physical vapor deposition, sputtering and pack diffusion.

Those features of the invention which are believed to be novel are set forth with particularity in the claims appended hereto. The invention will, however, be better understood from a consideration of the preferred embodiments.

DESCRIPTION OF THE PREFERRED EMBODIMENTS

The following examples are illustrative, and the claims are not to be construed as being limited thereto.

EXAMPLE 1

A commercial cemented carbide cutting tool insert of composition 85.5% WC, 6% TaC, 2.5% TiC and 6% Co was coated in the following manner:

1. Held 15 minutes at 1050° C. in an atmosphere of $H_2$—5% $CH_4$—2% $TiCl_4$—5% $TaCl_5$—10% $AlCl_3$.
2. Held 40 minutes at 1050° C. in an atmosphere of $H_2$—10% $CO_2$.
3. Held 10 minutes at 1050° C. in an atmosphere of $H_2$—10% $AlCl_3$.
4. Held 60 minutes at 1050° C. in an atmosphere of $H_2$—10% $CO_2$—10% $AlCl_3$.

This treatment resulted in a 4-micron $Al_2O_3$ coating which was firmly bonded to the cemented carbide substrate, through a bonding layer about 0.2 microns thick.

The coated insert was used to machine cast iron at 400 sfpm, 0.010 in./rev. feed rate, and the wear resistance was compared with that obtained using a commercial insert which requires a high temperature diffusion operation to make the coating.

The wear resistance of the insert coated by the above-described simplified process was found to be nearly equal to that of the commerical insert.

EXAMPLE 2

A cemented carbide insert having the same composition as Example 1 above was coated with $Al_2O_3$ in the following manner:

1. Held 15 minutes at 1050° C. in a gaseous mixture of $H_2$—2% $TiCl_4$—5% $NbCl_5$—10% $AlCl_3$, then the $TiCl_4$ was turned off and the insert was held an additional 10 minutes at 1050° C. in the remaining mixture of $H_2$—5% $NbCl_5$—10% $AlCl_3$.
2. Held 20 minutes at 1100° C. in a mixture of $H_2$—5% $CO_2$.
3. Held 20 minutes at 1050° C. in a mixture of $H_2$—10% $AlCl_3$.
4. Held 45 minutes at 1050° C. in a mixture of $H_2$—5% $CO_2$—10% $AlCl_3$.

The resultant coated insert had a 3-micron $Al_2O_3$ coating firmly bonded to the cemented carbide substrate, through a bonding layer about 0.2 microns thick.

When used to machine cast iron (same conditions as Example 1 above), the wear resistance was found to be equivalent to the commercial insert.

EXAMPLE 3

A cemented carbide insert having the same composition as Example 1 above was pretreated then coated with $Al_2O_3$ in the following manner at a furnace temperature of 1050° C. and 1 atmosphere pressure.

1. Held 10 minutes in a gaseous mixture of $H_2$—10% $CH_4$.
2. Held 1 minute in a gaseous mixture of $H_2$—2% $TiCl_4$.
3. Held 25 minutes in a mixture of $H_2$ and $NbCl_5$ (which had been heated for about 8 minutes to 320° F., held 3 minutes, and cooled with power off for 15 minutes).
4. Held 2 minutes in a gaseous mixture of $H_2$—2.5% $CO_2$.
5. Held 10 minutes in a gaseous mixture of $H_2$—5% $AlCl_3$.
6. Held 60 minutes in a gaseous mixture of $H_2$—5% $AlCl_3$—9% $CO_2$.

The resultant coated insert had a 3–4 microns $Al_2O_3$ coating firmly bonded to the cemented carbide substrate, through a bonding layer about 0.2 microns thick.

When used to machine cast iron (same conditions as Example 1 above), the wear resistance is found to be equivalent to the commercial insert.

EXAMPLE 4

The procedure of Example 3 was repeated, using the following conditions:

1. Held 1 minute at 1050° C. in a gaseous mixture of $H_2$—3% $TiCl_4$.
2. Held 1 minute at 1050° C. in a gaseous mixture of $H_2$—3% $TiCl_4$—20% $N_2$.
3. Held 30 minutes in $H_2$—3% $NbCl_5$; +3% $TiCl_4$ added for 20 seconds during middle of this period and temperature was 850° C. for first 10 minutes of this period and then increased in a linear fashion to 1050° C. by end of the period.
4. Held 10 minutes at 1050° C. in $H_2$—11% $CO_2$.
5. Held 10 minutes at 1050° C. in $H_2$—7% $AlCl_3$.
6. Held 60 minutes in gaseous mixture of $H_2$—11% $CO_2$—7% $AlCl_3$.

A coated insert according to this invention was obtained.

The use of tantalum or niobium chloride in the steps of the above examples is critically specific for the achievement of the desired high level of coating adherence in a single furnace operation. While titanium chloride may be used in these steps in addition to tantalum or niobium chloride, the adherence is not as good if only titanium chloride is used. Since vanadium belongs to the same group as tantalum and niobium (Group VB), its effectiveness is probable.

Many variations will suggest themselves to those skilled in this art in light of the above-detailed description. All obvious such variations are within the full intended scope of the invention as defined by the appended claims.

I claim:

1. An article for cutting and wear parts comprising:
(i) a hard metal or cemented carbide substrate;

(ii) a surface-oxidized bonding layer adjacent the surface of said substrate, which is capable of adherently accepting an oxide overlayer at coating temperatures of from approximately 800° C. to 1300° C., said bonding layer comprising at least one of the carbides or oxycarbides of tantalum, niobium and vanadium; and (iii) an oxide wear layer overlying said bonding layer.

2. An article as defined in claim 1 wherein the substrate is a cemented carbide, and the bonding layer is 0.1 to 0.5 microns thick.

3. An article as defined in claim 1 wherein bonding layer (ii) includes aluminum.

4. An article as defined in claim 1 wherein oxide wear layer (iii) comprises aluminum oxide.

5. An article as defined in claim 1 wherein oxide wear layer (iii) is 0.5 to 20 microns thick.

* * * * *